US007338267B2

(12) United States Patent
Patterson

(10) Patent No.: US 7,338,267 B2
(45) Date of Patent: Mar. 4, 2008

(54) HINGED PADDLE PUMP

(75) Inventor: Albert W. Patterson, West Lorne (CA)

(73) Assignee: 1564330 Ontario Inc., Ontario (CA)

( * ) Notice: Subject to any disclaimer, the term of this patent is extended or adjusted under 35 U.S.C. 154(b) by 850 days.

(21) Appl. No.: 10/791,287

(22) Filed: Mar. 3, 2004

(65) Prior Publication Data

US 2005/0196299 A1 Sep. 8, 2005

(51) Int. Cl.
*F04C 2/00* (2006.01)
*F04C 18/00* (2006.01)

(52) U.S. Cl. ..... 418/268; 418/82; 418/183; 418/188; 418/260

(58) Field of Classification Search ..... 418/260, 418/259, 266–268, 82, 183, 188
See application file for complete search history.

(56) References Cited

U.S. PATENT DOCUMENTS 23,764 A * 4/1859 Freeman, Jr. ..... 418/260
68,186 A * 8/1867 Hall ..... 418/255
390,044 A * 9/1888 Voorhies ..... 418/260
1,349,353 A * 8/1920 Wilber, Jr. ..... 418/260
1,972,744 A * 9/1934 Lister ..... 418/255
2,536,938 A * 1/1951 Hunter ..... 418/265
4,415,322 A * 11/1983 Baudin ..... 418/260
5,163,825 A * 11/1992 Oetting ..... 418/268
6,554,596 B1 4/2003 Patterson et al.

OTHER PUBLICATIONS

U.S. Appl. No. 10/680,236, filed Oct. 8, 2003; Albert W. Patterson "Rotary Pistons" (Specification, Preliminary Amendment, Drawings and Filing Receipt) having a U.S. Patent No. 6,945,218.

* cited by examiner

*Primary Examiner*—Theresa Trieu
(74) *Attorney, Agent, or Firm*—Nixon Peabody LLP; Jeffrey L. Costellia

(57) ABSTRACT

A rotary pump for fluids comprising a shaft to rotate about a longitudinal axis and a cylindrical rotor centrally secured to that shaft. A housing encasing the shaft and rotor includes, interior end walls adjacent to the rotor disks and an interior side wall. Fluid inlet and outlet ports are provided at spaced locations in the housing side wall. Paddles are pivotably secured to the rotor in pockets in the rotor, to pivot about points at rearward sides of the paddles, for movement between extended positions with the paddles extending outwardly beyond the cylindrical surface of the rotor and retracted positions where the paddles are seated entirely within their corresponding pockets. A means is provided to bias each paddle towards the extended position, but to allow the paddle to move towards that extended position, but to allow the paddle to move towards the retracted position.

12 Claims, 5 Drawing Sheets

HINGED PADDLE PUMP

FIELD OF THE INVENTION

The present invention relates to a rotary, positive displacement pump for fluids, and more particularly to such a pump having a housed rotor with pivoting paddles.

BACKGROUND OF THE INVENTION

The present invention falls within a family of inventions by the inventor such as those described in U.S. Pat. No. 6,554,596 entitled "FLUID TURBINE DEVICE" issued Apr. 29, 2003 and U.S. patent application Ser. No. 10/680,236, entitled "ROTARY PISTONS". These inventions essentially relate to rotary pistons, motors and pumps in the nature having encased rotors with radially extending vanes which move in and out of the rotors, depending on their location within the casing. The vane movement in and out of the rotor is achieved by cam surfaces within the casing. The walls of the casing are not of uniform radius, and are formed so as to facilitate movement of the vanes and flow of fluid between inlet and outlet ports in the casing.

There has been a need to develop a pump which is stronger than conventional pumps, and which can be used in applications for moving heavy fluids or fluids with solids in them.

It is an object of the present invention to provide an improved pump for such applications.

SUMMARY OF THE INVENTION

In accordance with the present invention there is provided a rotary pump for fluids. The pump comprises a shaft to rotate about a longitudinal axis and a rotor centrally secured to the shaft. The rotor has a body with a cylindrical surface which extends between spaced ends. Rotor disks are secured to the rotor at each end, and secured at their centers to the shaft. A housing encases the shaft and rotor and rotor disks within an internal cavity, with the shaft extending outside of the housing. The housing has interior end walls adjacent to the rotor disks and an interior side wall. Fluid inlet and fluid outlet ports are provided in the side wall. A first portion of the interior side wall of the housing is cylindrical and curved with constant radius over an angle of about approximately 180°. This portion is spaced a constant distance from confronting portions of the cylindrical surface of the rotor. A second portion of the interior side wall of the housing extends between the extremities of the first portion of the interior side wall and is of curvature of greater radius than that of the first portion. The cylindrical surface of the rotor is proximal to the interior side wall of the housing at a point between the inlet and outlet ports about midway on the second portion. The inlet and outlet ports are located in this second portion of the interior side wall of the housing. A plurality of equally spaced, similarly contoured pockets are provided, extending longitudinally across its cylindrical surface.

A similar paddle is secured to the rotor in each pocket, to pivot about a point at a rearward side of the paddle, for movement between an extended position with a portion of the paddle extending outwardly beyond the cylindrical surface of the rotor, and a retracted position wherein the paddle is seated entirely within its corresponding pocket. The paddles extend longitudinally the length of the pockets and are spaced from adjacent paddles so that there is always at least one paddle positioned between the inlet port and the outlet port. Each paddle and pocket are configured so that when the paddle is in retracted position, it provides an exterior surface which conforms to the cylindrical surface of the rotor and closes the pocket, and between that position and extended position, it bears against the interior side wall of the housing while still closing the pocket. A means is provided to bias each paddle towards extended position, but to allow the paddle to move towards retracted position under urging of the interior side wall during operation of the device.

The rotor disks, housing and paddles are constructed so that, during operation of the device, fluid entering the housing through the inlet port is carried by the rotor, in sealed compartments formed between adjacent paddles, the rotor cylindrical surface between those paddles, the rotor disks and corresponding portions of the side wall of the housing, until the adjacent vanes encompass the outlet port where the fluid is expelled from the housing.

In a preferred embodiment, each paddle has outwardly extending shoulders at opposite ends. The shoulders extend into corresponding pockets formed at appropriate locations in the rotor disks. The pockets in the rotor disks are formed so as to restrict further outward movement of the corresponding shoulder of the paddle with respect to the cylindrical surface of the rotor when the paddle is at its extended position, and to restrict further inward movement of that shoulder when the paddle is at its retracted position.

The pump according to the present invention provides a device which is relatively cheap to construct, since it needs only the side wall of the casing as its cam surface for operation of the paddles. As will be discussed in more detail subsequently herein, a pump according to the present invention is particularly well suited for movement of heavy fluids or even fluids with solids in them. A wide range of applications for the pump according to the present invention is envisaged.

BRIEF DESCRIPTION OF THE DRAWINGS

These and other advantages of the invention will become apparent upon reading the following detailed description and upon referring to the drawings in which.

Figure 1:
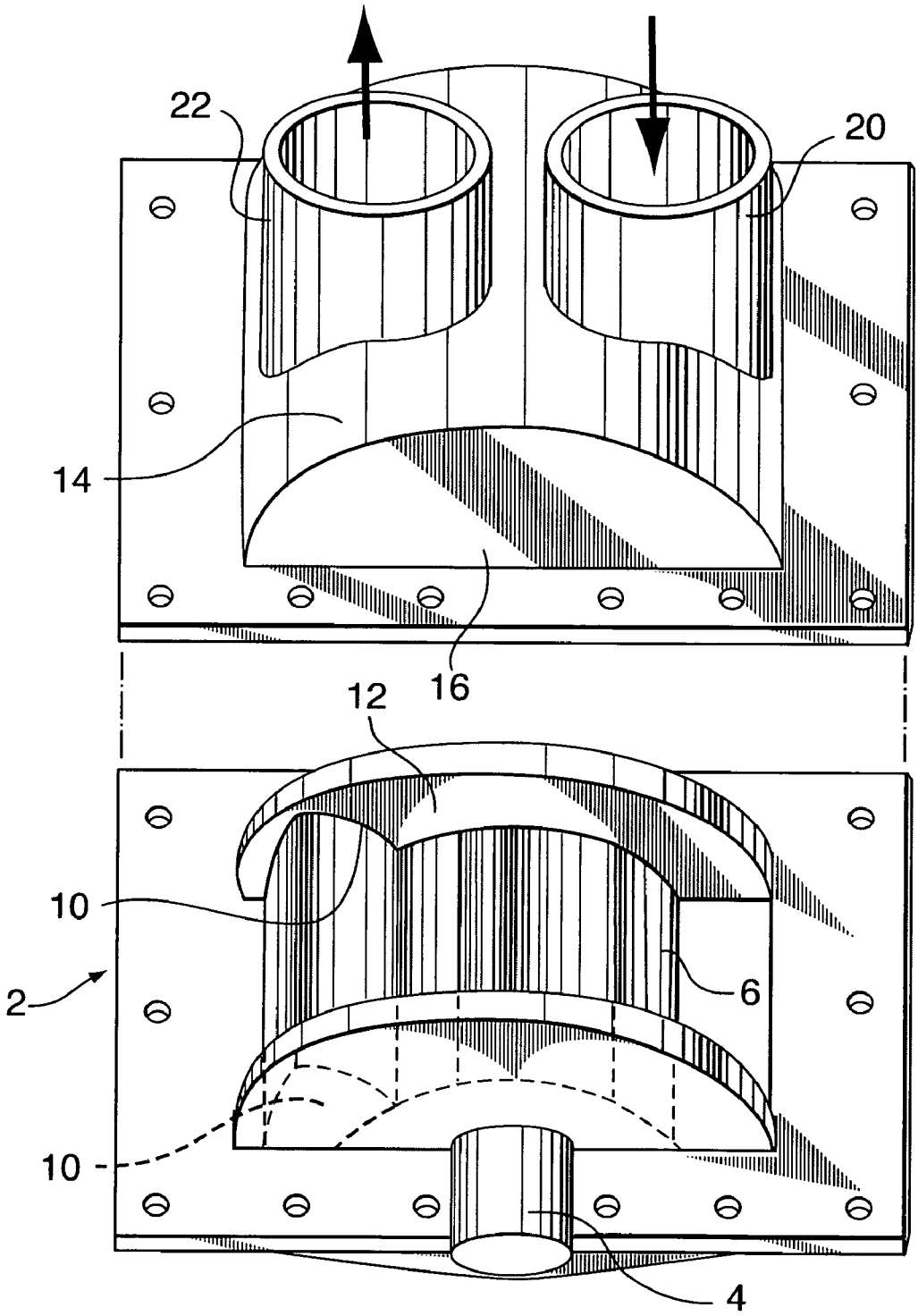
FIG. 1 is a perspective view of a partially disassembled pump casing, including rotor and associated paddles in accordance with the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE ILLUSTRATED EMBODIMENTS

In the following description, similar features in the drawings have been given similar reference numerals.

Figure 2:
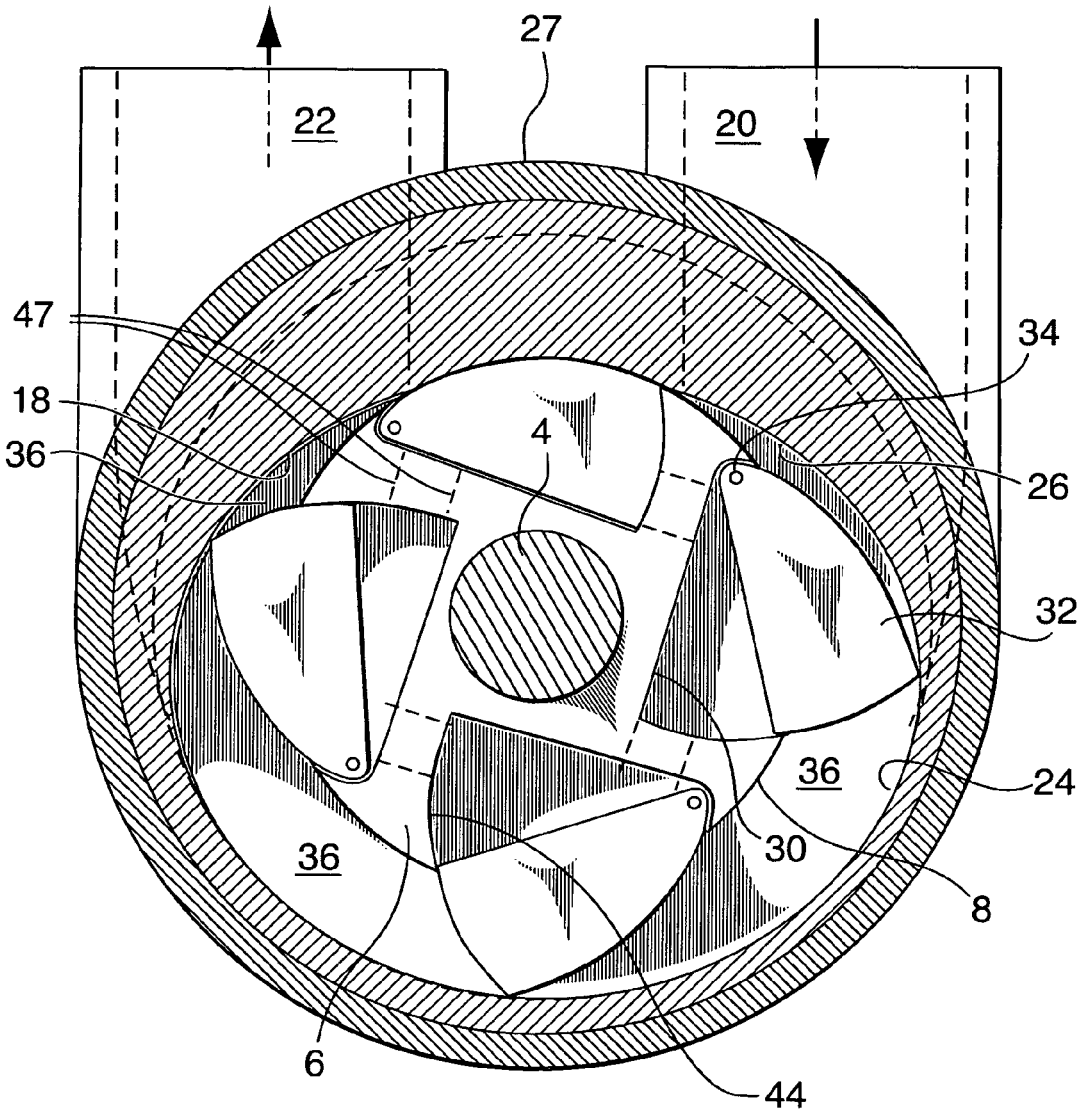
FIG. 2 is a section view of the pump, including the rotor and paddles of FIG. 1, illustrating the operation of the pump according to the present invention.

Turning to the figures, a rotary pump 2 in accordance with the present invention is illustrated in FIGS. 1 and 2. It comprises a shaft 4 to rotate about a longitudinal axis, the shaft driven by any appropriate means of power. A rotor 6 is centrally secured to the shaft. The rotor has a body with a cylindrical surface 8 extending between spaced ends 10. At each end 10 a rotor disk 12 is secured as illustrated. (Rotor disks 12 may be formed integrally with rotor 6 or may be made separately and then secured to rotor 6.) In the embodiment of FIGS. 1 and 2, rotor disks 12 are of a greater diameter than that of rotor 6. In the alternative embodiment illustrated in FIG. 5, those disks 12 are of the same diameter as that of rotor 8.

A housing 14 encases the shaft 4, rotor 6 and rotor disks 12, providing an internal cavity within which the rotor operates. The housing 14 has interior end walls 16 adjacent to the rotor disks 12 and an interior side wall 18 extending between those end walls 16. A fluid inlet port 20 and fluid outlet port 22 are provided at spaced locations, as illustrated, in interior side wall 18. A first portion 24 of the interior side wall of the housing is cylindrical and curved with a constant radius over an angle of about 180°. This portion is spaced a constant distance from confronting portions of the cylindrical surface 8 of rotor 6. A second portion 26 of the interior side wall of the housing extends between the extremities of that first portion 24 of the interior side wall 18 and is of curvature of greater radius than that of the first portion.

As can be seen in FIG. 2, the cylindrical surface 8 of the rotor 6 is proximal to the interior side wall 18 of the housing at a point 27 between inlet and outlet ports 20 and 22 respectively, and is located about midway on second portion 26 of interior side wall 18. These inlet and outlet ports 20 and 22 are located in this second portion 26 of the interior side wall of the housing.

A plurality (four in the illustrated embodiment) of equally spaced, similarly contoured pockets 30 are provided in the rotor 6, extending longitudinally across its cylindrical surface 8.

Figure 3:
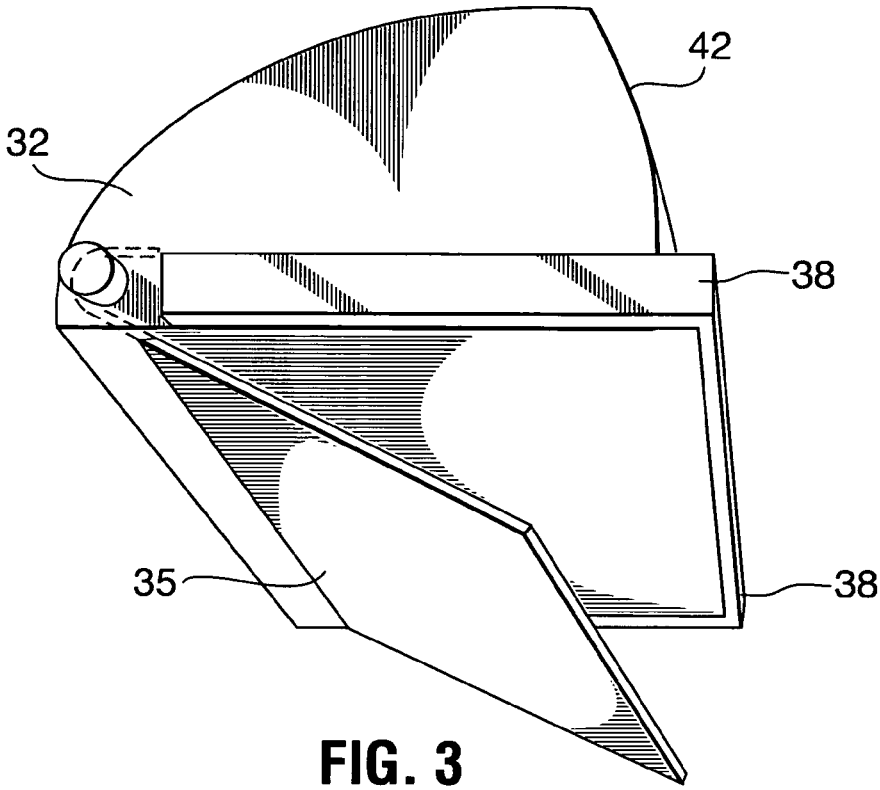
FIG. 3 is perspective view of a paddle according to the present invention.

A paddle 32 is secured to rotor 6 in each pocket 30 at a pivot point 34 located in a rearward side of each paddle 32, for movement of the paddle between an extended position with a portion of the paddle extending outwardly beyond this cylindrical surface 8 of rotor 6, and a retracted position wherein the paddle 32 is seated entirely within its corresponding pocket 30. These paddles, one which is illustrated in more detail in FIG. 3, are of similar shape and configuration, and extend longitudinally the length of the pockets 30. Each paddle 32 is spaced from adjacent paddles 32 so that there is at least one paddle position between the inlet port 20 and outlet port 22. The paddles 32 and pockets 30 are configured, as illustrated, so that when the paddle 32 is in retracted position, it provides an interior surface which conforms to the cylindrical surface of the rotor and closes the pocket, and between that position and when it is in extended position, it bears against the interior side wall 18 of the housing 14, while still closing its corresponding pocket 30. A bias means, preferably a leaf spring 35 (FIG. 3), is provided in each pocket 32 to urge its corresponding paddle 32 towards extended position, but to allow the paddle to move towards retracted position under urging of the interior side wall 18 of the housing, which acts as a cam surface, during operation of the device.

The rotor disks 12, housing 14 and paddles 32 are constructed so that, during operation of the device, fluid entering housing 14 through the inlet port 20 is carried by the rotor, in compartments 36 (see FIG. 2 for example) formed between adjacent paddles 32, the rotor surface 8 between those paddles, the rotor disks 12 and corresponding portions of the side wall 18 of the housing, until those adjacent paddles encompass the outlet port, at which point the fluid is expelled from the housing as a result of the diminishing volume contained within that particular compartment as it approaches and passes the outlet port 22.

Additional strength for the pump is accomplished by providing outwardly extending shoulders 38 (see FIG. 3) at opposite ends of paddles 32. These shoulders extend into corresponding pockets 40 formed at appropriate locations in the rotor disks 12. These pockets 40 are formed, as illustrated by the phantom outline in FIG. 7, so as to restrict outward movement of the corresponding shoulder 38 with respect to the cylindrical surface 8 of rotor 6 when the paddle 32 is at its extended position, and to restrict further inward movement of that shoulder when the paddle is at its retracted position.

As can be seen in FIGS. 2 and 3, a forward surface 42 of each paddle is of arcuate shape in lateral cross section, with the pivot point 34 of the paddle 32 being the center of curvature of the arc. A corresponding side 44 of the corresponding pocket is curved to mate with that forward surface.

As can be seen in FIG. 2, channels 47 are provided in lower portions of each pocket 30 so as to enable fluid which may seep into the pocket below its corresponding paddle 32, to be forced from that pocket as its corresponding paddle 32 moves towards retracted position during operation of the device.

Figure 4:
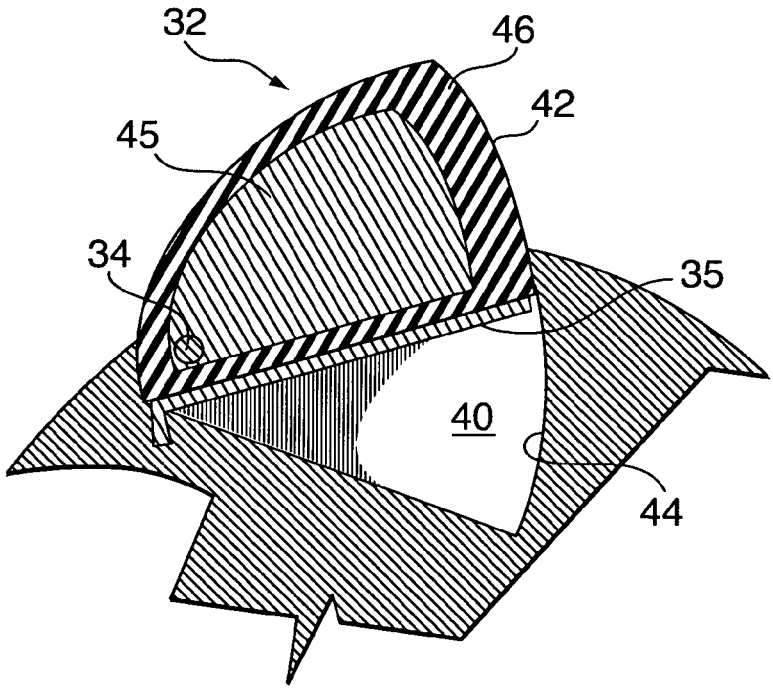
FIG. 4 is a schematic, lateral section view of a paddle and portion of the rotor according to the present invention.

While paddles 32 will normally be of solid material such as metal, as illustrated in FIG. 4, depending upon the application, paddles 32 may alternatively be constructed with a metal core 45 and coated with a material 46 such as rubber. Also, the pocket 40 in the end disks may be filled with compressible foam and covered with a vinyl or silicone seal sheet. These features will assist in providing better seals for the chambers during operation, thereby improving the power and efficiency of the pump.

Figure 5:
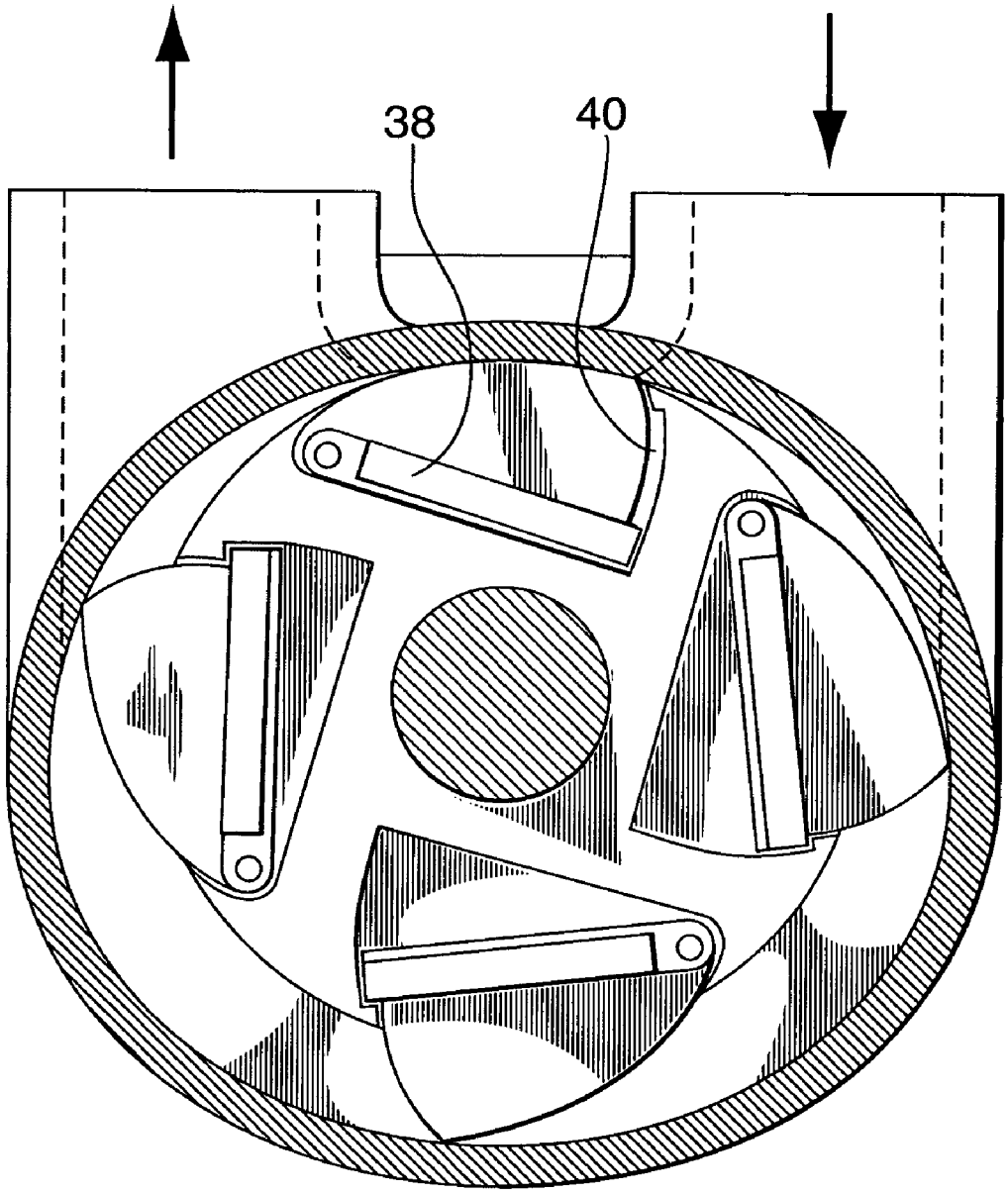
FIG. 5 is a section view of an alternative embodiment of the pump according to the present invention, having smaller rotor disks.

In FIG. 5, a rotor and paddle arrangement similar to that of FIG. 2 is illustrated but associated with rotor disks 12 of diameter similar to that of rotor 6. This construction of pump 2 according to the present invention, with smaller rotor disks then those of the embodiment of FIGS. 1 and 2, is simpler and cheaper to construct. This embodiment will tolerate a wider range of fluid temperature conditions and can be probably a smaller size.

In an alternative embodiment (FIGS. 6 and 7), the shoulders 38 of paddles 34 may be provided with outwardly extending guides 48, these guides being provided at a location near the forward surface 42 of the paddles. These guides extend through appropriate slots 49 (FIG. 7) in the adjacent rotor disks 12, and bear against a cam surface 50 (phantom, FIG. 7) which for example is formed by an appropriately positioned race in the proximal end wall 16 of the housing so that, during operation of the device, as the paddles rotate on rotor 6, extra force is provided on the paddles to move them to retracted position across the outlet 22. For instance, when fluids have solid materials in them, these solid materials may otherwise interfere with the movement of paddles 32 towards retracted position as they approach the outlet port 22.

Figure 6:
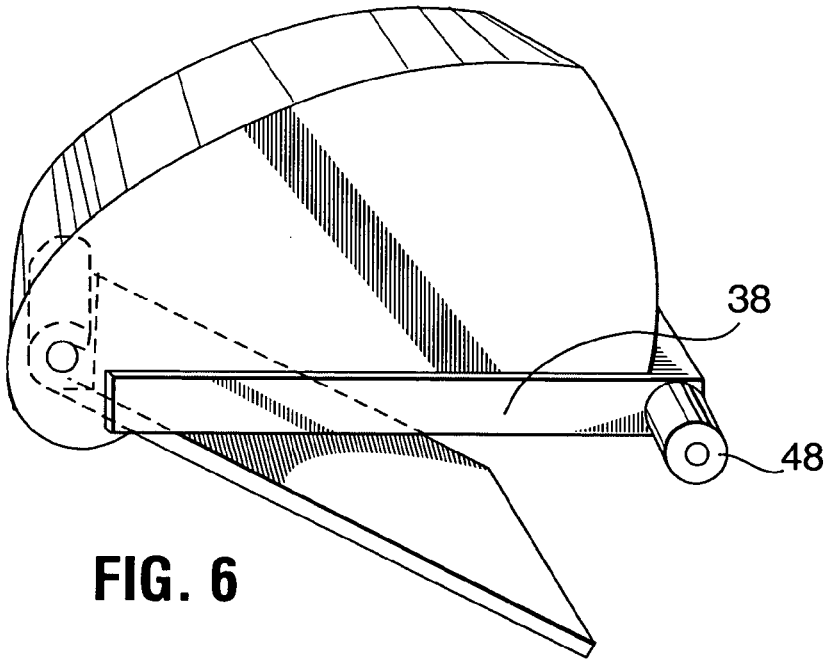
FIG. 6 is a perspective view of an alternative embodiment of paddle according to the present invention, having a guide for enhancing the operation of the paddle under certain conditions.
Figure 7:
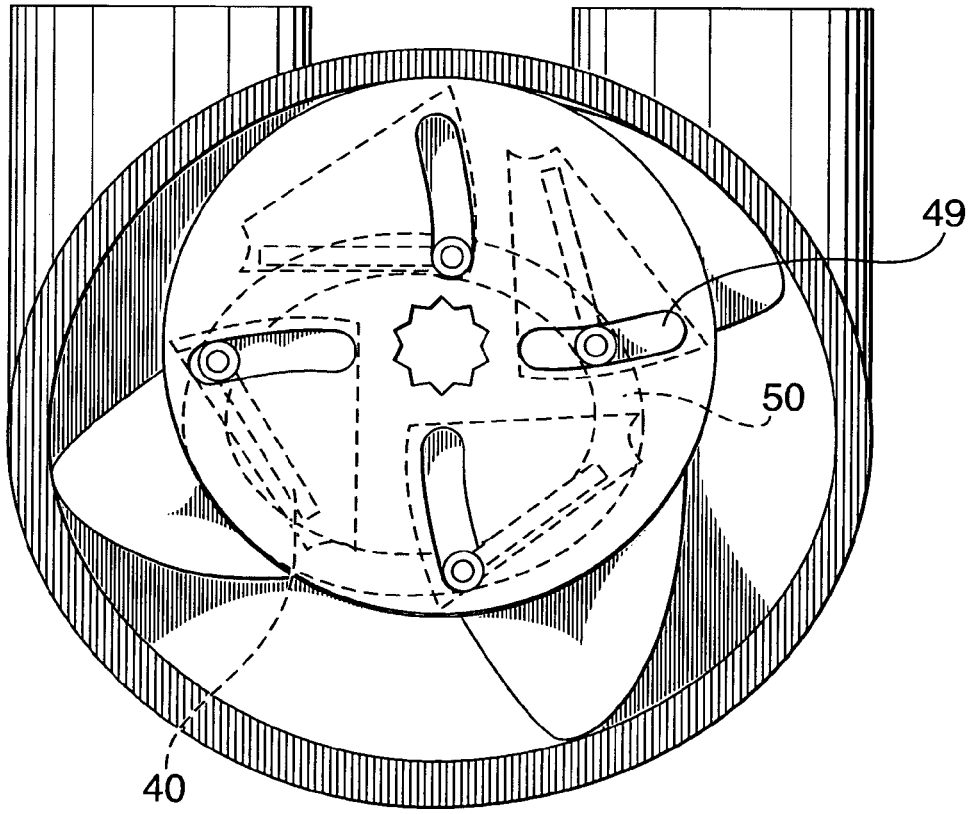
FIG. 7 is an end view, with a portion of the casing removed, of an alternative embodiment of a pump in accordance with the present invention, incorporating paddles in accordance with FIG. 6.

This embodiment of pump in accordance with the present invention, as illustrated in FIGS. 6 and 7, is particularly useful when solids in the fluid being pumped are rags, rope or the like, which could lodge on the closing cam surface 18 of housing 14 at outlet port 22. With these outwardly extending guides 48, the pump housing 14 does not need to be configured as a closing cam surface, so that more free area with less restricting interventions results at this outlet port.

The pump according to the present invention is especially useful for fluids with debris in them or for slurries and aggregates.

Thus, it is apparent that there has been provided in accordance with the invention a hinged paddle pump device that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A rotary pump for fluids comprising:

a shaft to rotate about a longitudinal axis;

a rotor centrally secured to the shaft, the rotor having a body with a cylindrical surface extending between spaced ends;

a rotor disk secured to the rotor at each end and secured at its center to the shaft;

a housing encasing the shaft, rotor and rotor disks within an internal cavity, the shaft extending outside of the housing, the housing having interior end walls adjacent to the rotor disks and an interior side wall, with fluid inlet and fluid outlet ports at spaced locations in the side wall, a first portion of the interior side wall of the housing being cylindrical and curved with constant radius over an angle of about approximately 180°, this portion being spaced a constant distance from confronting portions of the cylindrical surface of the rotor, and a second portion of the interior side wall of the housing extending between the extremities of the first portion of the interior side wall and being of curvature of greater radius than that of the first portion;

the cylindrical surface of the rotor being proximal to the interior side wall of the housing at a point between the inlet and outlet ports about midway on the second portion, the inlet and outlet ports being located in this second portion of the interior side wall of the housing;

a plurality of equally spaced, similarly contoured pockets in the rotor, extending longitudinally across its cylindrical surface;

a similar paddle, secured to the rotor in each pocket, to pivot about a point at a rearward side of the paddle, for movement between an extended position with a portion of the paddle extending outwardly beyond the cylindrical surface of the rotor, and a retracted position wherein the paddle is seated entirely within its corresponding pocket, the paddles extending longitudinally the length of the pockets and being spaced from adjacent paddles so that there is always at least one paddle positioned between the inlet port, each paddle and pocket configured so that when the paddle is in retracted position it provides an exterior surface which conforms to the cylindrical surface of the rotor and closes the pocket, and between that position and extended poison, it bears against the interior side wall of the housing while still closing the pocket;

means for biasing each paddle towards extended position, but to allow the paddle to move towards retracted position under urging of the interior side wall during operation of the device;

the rotor disks, housing and paddles constructed so that, during operation of the device, fluid entering the housing through the inlet port is carried by the rotor, in compartments formed between adjacent paddles, the rotor cylindrical surface between those paddles, the rotor disks and corresponding portions of the side wall of the housing, until the adjacent paddles encompass the outlet port where the fluid is expelled from the housing.

2. A pump according to claim 1, wherein each paddle has outwardly extending shoulders at opposite ends, the shoulders extending into corresponding pockets formed at appropriate locations in the rotor disks, the pockets in the rotor disks formed so as to restrict further outward movement of the corresponding shoulder of the paddle with respect to the cylindrical surface of the rotor when the paddle is at its extended position, and to restrict further inward movement of that shoulder when the paddle is at its retracted position.

3. A pump according to claim 2, wherein an external, forward surface of each paddle is of arcuate shape in lateral cross section, with pivot of the paddle being the center of curvature of the arc, and a corresponding edge of the corresponding pocket is curved to mate with that forward surface.

4. A pump according to claim 2, wherein the rotor disks are of integral construction with the rotor.

5. A pump according to claim 2, wherein an outwardly extending guide is provided on each shoulder at a location near a forward surface of each paddle, the guides being located a similar distance from the pivot point of the paddles, the guides extending through slots in their corresponding rotor disks into races formed in the end walls of the housing to provide additional force on the paddles to move them to retracted position in the vicinity of the outlet port during operation of the pump.

6. A pump according to claim 1, wherein a forward surface of each paddle is of arcuate shape in lateral cross section, with the pivot point of the paddle being the center of curvature of the arc, and a corresponding edge of the corresponding pocket is curved to mate with that forward surface.

7. A pump according to claim 1 in combination with a drive means to rotate the shaft.

8. A pump according to claim 1, wherein the rotor disks are of integral construction with the rotor.

9. A pump according to claim 1, wherein the bias means for the paddles are leaf springs seated in the pockets.

10. A pump according to claim 1, wherein channels are provided in lower portions of each pocket to provide fluid communication with an adjacent pocket so as to enable fluid to be forced from a pocket as its corresponding paddle moves towards retracted position, during operation of the device, to that adjacent pocket.

11. A pump according to claim 1, wherein the rotor disks are of a diametrical size conforming to that of the rotor.

12. A pump according to claim 1, wherein the rotor disks are of a diametrical size greater than that of the rotor.

* * * * *